United States Patent [19]

Telling

[11] 4,213,386

[45] Jul. 22, 1980

[54] COMPACTING APPARATUS

[75] Inventor: Vera I. Telling, Worthing, England

[73] Assignee: Trewhella Bros. (UK) Ltd., Great Britain

[21] Appl. No.: 927,530

[22] Filed: Jul. 24, 1978

[30] Foreign Application Priority Data

Aug. 10, 1977 [GB] United Kingdom ..... 33436/77
Aug. 10, 1977 [GB] United Kingdom ..... 33437/77

[51] Int. Cl.[2] ..... B30B 9/32

[52] U.S. Cl. ..... 100/98 R; 100/DIG. 2; 100/209; 100/218; 241/99

[58] Field of Search ..... 100/98 R, 209, DIG. 2, 100/218; 241/99

[56] References Cited

U.S. PATENT DOCUMENTS

| | | | |
|---|---|---|---|
| 809,512 | 1/1906 | Von Der Linde | 100/DIG. 2 |
| 2,602,483 | 7/1952 | Graham | 100/DIG. 2 |
| 2,737,995 | 3/1956 | Jennings | 100/DIG. 2 |
| 3,011,429 | 12/1961 | Kuslich | 100/DIG. 2 |
| 3,983,800 | 10/1976 | Booth | 100/209 X |

*Primary Examiner*—Billy J. Wilhite
*Attorney, Agent, or Firm*—Roylance, Abrams, Berdo & Farley

[57] ABSTRACT

A double-acting compacting apparatus comprises two movable compaction plates and stationary compaction plate arranged between said movable plates. Arranged between respective ones of said movable plates and said stationary plate is a free-fall aperture through which compacted objects can fall under gravity. Means are provided for connecting the movable plates together such that during a compaction stroke utilizing one of said movable plates the other of said movable plates defines with said stationary plate a space for receiving further material to be compacted.

5 Claims, 4 Drawing Figures

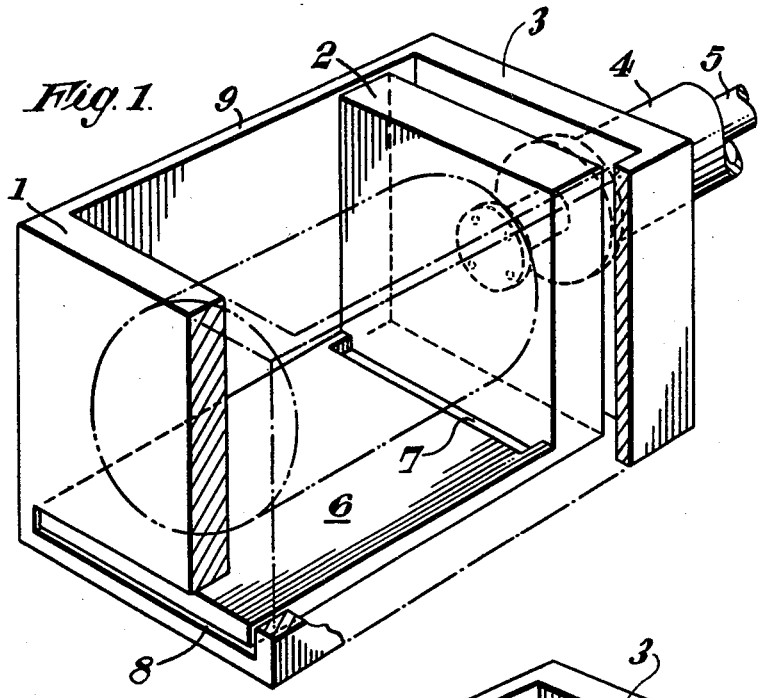
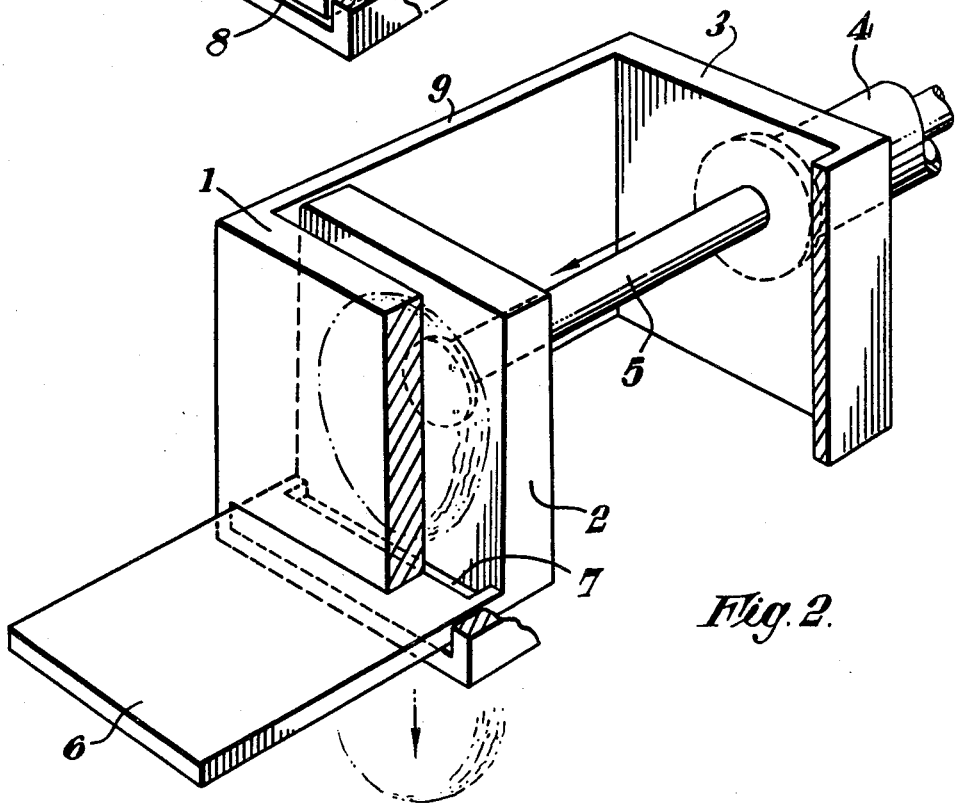
Fig. 2.

COMPACTING APPARATUS

The present invention relates to compacting apparatus. The term compacting apparatus as used here and in the following is meant also to include crushing apparatus such as those used to break and crush bottles and other brittle containers.

An object of the present invention is to provide a compacting apparatus in which objects, such as tin cans, bottles and like waste, can be compacted or crushed in an easy and efficient manner.

A further object of the present invention is to provide such a compacting apparatus in which a compacted object or objects is or are permitted to fall freely from the apparatus.

Still another object of the present invention is to provide such a compacting apparatus in which the ends of containers, such as cans and drums, comprising a metal different from the metal of the body of the container can be removed from said container during a compacting operation.

Briefly described, the invention comprises a double-acting compacting apparatus comprising a first compacting plate, a second compacting plate attached to and spaced from said first compacting plate; a third, stationary compacting plate arranged between said first and said second compacting plates; means for mounting said first compacting plate and said second compacting plate for movement relative to said third compacting plate; drive means coupled to at least one of said plates for providing movement of said first and said second plates relative to said third plate, and means for defining a free-fall aperture arranged such that compacted material can automatically fall freely from the apparatus upon completion of a compaction stroke.

For the purpose of supporting an object to be crushed or compacted between the mutually opposing faces of the first and second compacting plates, the plates may be arranged to co-operate with a floor means which will define an aperture through which a compacted object is able to fall freely, e.g. into a container placed beneath said aperture.

Since the end covers of many metal cans are made of a material, such as aluminium, different to that of the remainder of the can, it is desirable to be able to separate these end covers from respective can bodies prior to the final compaction of said cans. The waste thus collected is far more valuable than waste in which the end covers are compacted in situ with their respective can bodies. Consequently in accordance with a further embodiment of the invention, one of said opposing faces of said plates is provided with a means, such as a cutting device, for removing the end covers of respective cans before the compaction thereof is completed. This cutting device may have the form of a hollow tube extending through an associated compacting plate and having a diameter which is slightly smaller than the diameter of cans being compacted. The tube will project slightly beyond the plane of the face of the plate and will preferably be provided with cutting teeth at the end thereof facing a can.

The first compacting plate and the second compacting plate are rigidly connected together by wall means extending therebetween and when the object-support means has the form of a floor means, said floor means may extend between said first and said second plates to terminate at a given distance therefrom to define a respective gap therewith. The compacting unit comprising the first compacting plate, the second compacting plate, the connecting walls and, optionally the floor means may be arranged for reciprocating movement, towards and away from the intermediate, in this case stationary compacting plate. In this case, the unit may be driven by a single prime mover arranged to co-operate with one of the said plates to cause said reciprocating movement. Alternately, a prime mover may be arranged to co-operate with each of said first and said second plates.

Conveniently a plurality of said single-compacting apparatus or said double-acting compacting apparatus may be arranged in line and/or in side-by-side relationship to form a compacting plant in which the respective compacting apparatus may be arranged to receive objects of the same or similar type, or may be arranged to receive objects for compaction or crushing of differing types.

So that the invention will be more readily understood and optional features thereof made apparent, exemplary embodiments of the invention will now be described with reference to the accompanying schematic drawings, in which:

FIG. 1 is a perspective view, partly in section, of a single compacting apparatus with the movable compacting plate in its starting position;

FIG. 2 is a view similar to that of FIG. 1 with the movable compacting plate in its final compacting position.

Figure 3:
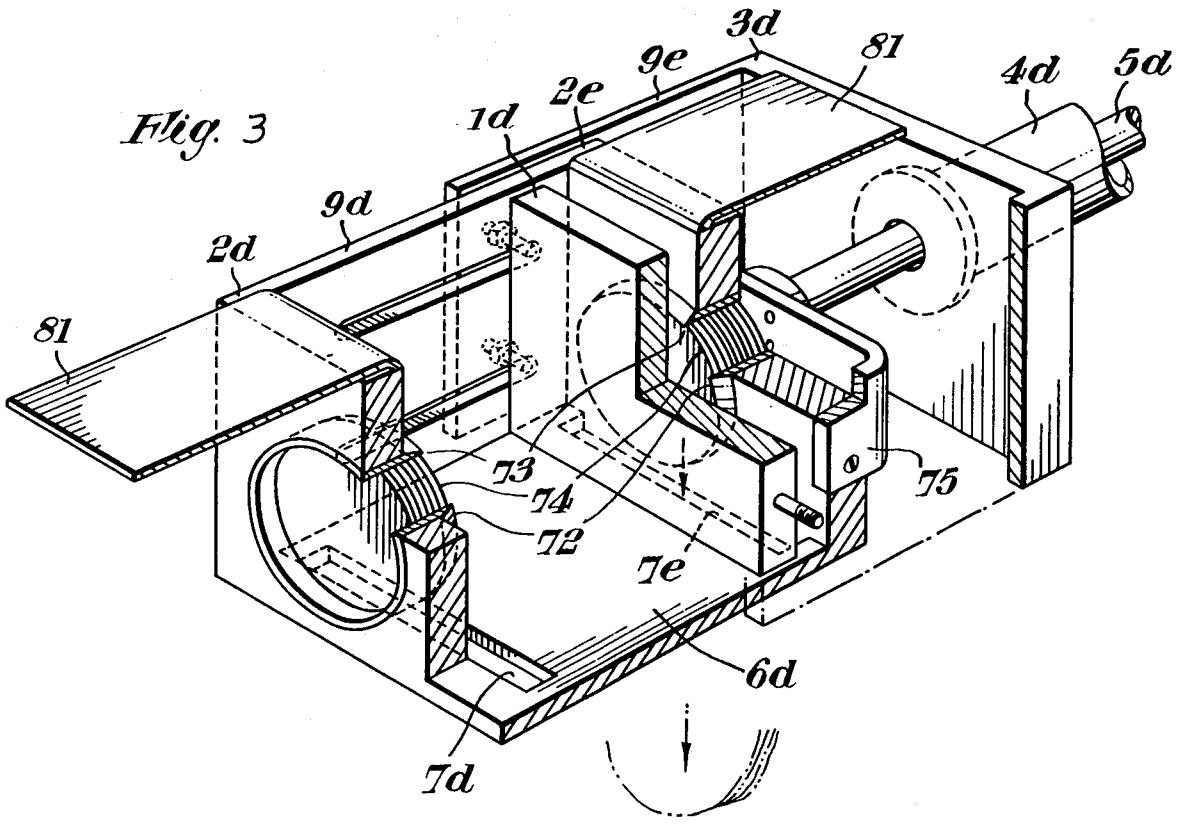
FIG. 3 is a perspective view, partly in section, of a double-acting compacting apparatus in accordance with the invention.
Figure 4:
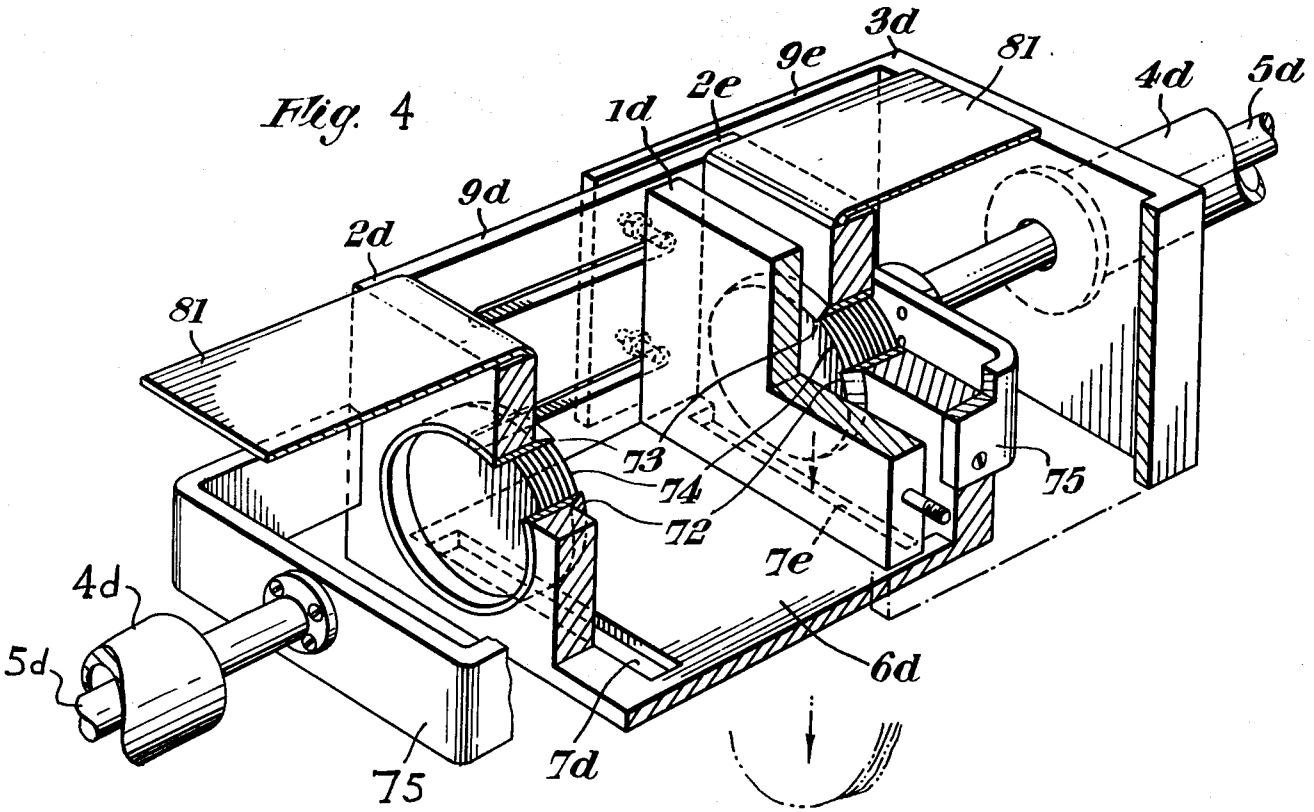
FIG. 4 is a perspective view, partly in section, of an apparatus as shown in FIG. 3 but with plate drive means at both ends of the apparatus.

In FIGS. 1 and 2 there is illustrated, for purposes of explanation of operation, a single compacting apparatus comprising a stationary compacting plate 1 and a compaction plate 2 which is arranged for reciprocating movement, towards and away from said stationary plate 1. The stationary compacting plate 1 is rigidly connected by means of ties or wall means 9 to an end wall 3 on which there is mounted a cylinder 4 in which a piston 5 is arranged for axial movement. One end of the piston extends through an aperture in the wall 3 and is connected to the movable compacting plate 2 in order to move said plate towards and away from said stationary plate 1. In the illustrated embodiment the movable compacting plate 2 has connected thereto an object-support means in the form of a floor 6 having an elongate free-fall aperture 7 arranged therein adjacent the plate 2. The longitudinal axis of the aperture 7 is parallel with the longitudinal axis of the plate 2, as seen in the Figure, and the length and width of the aperture is determined by the size of the objects to be compacted and the degree of compaction to which they are to be subjected. The stationary compacting plate 1 is provided with a slot 8 through which the floor 6 can pass as the plate 2 approaches the stationary plate 1. Alternately the floor may be arranged to pass beneath the stationary plate or in a groove therein.

FIG. 2 illustrates the position of the movable plate 2 relative to the stationary plate 1 at the end of a compacting stroke of the piston 5, the floor 6 having passed through slot 8 to an extent such that the aperture 7 is located immediately beneath the compacted object, thereby enabling the compacted object to fall freely through said aperture and away from said apparatus, as illustrated by the compacted can shown in ghost lines.

Although the drawing shows the floor 6 to be connected to the movable plate 2, the floor may be connected in some suitable manner to the stationary plate 1, in which case the free-fall aperture 7 will be arranged adjacent the stationary plate 1. The slot 8 through which the floor 6 slides will then be disposed in the movable plate 2 and the distance between the plate 2 and the end wall 3 will be such as to allow the floor to move through the plate 2 to an extent such that the free-fall aperture will be located beneath the compacted object.

When compacting, for example, large cylindrical cans or drums, it may be more convenient to compact the cans or drums sideways on, i.e. with a long axis of the can or drum extending parallel to the long axis of the free-fall aperture, thereby reducing the necessary length of working stroke. Although a large can or drum can be compacted sideways on by means of the illustrated apparatus with floor 6 and free-fall aperture 7, the compacted can will, in this case, often exhibit a lip which will render uniform stacking of the can and, when the apparatus is also to be used to empty the can as hereinafter described, the complete emptying thereof more difficult. Consequently, it may be more convenient to support the can generally centrally of the plates 1 and 2, i.e. to omit the floor 6 and to support the can by some other, retractable means.

FIG. 3 illustrates the manner in which two of the aforedescribed compacting apparatus can be joined in tandem to form a double-acting compactor, i.e. an apparatus which will compact in both directions of movement of two interconnected movable compacting plates 2. In this embodiment the apparatus comprises two movable compacting plates **2*d* and 2*e* which are rigidly connected in spaced apart relationship by means of ties, which in the embodiment shown have the form of side walls 9*d*. Arranged between the two movable plates 2*d* and 2*e* is a stationary compacting plate 1*d* which is connected to an end wall 3*d* spaced therefrom, by means of the ties 9*e*, which may also have the form of side walls, as shown. Wall 1*d* can be rigidly attached to wall 9*e* in the manner illustrated which includes threaded studs 12 protruding outwardly from the side edges of wall 1*d* and passing through slots 14 in walls 9*d*. The studs pass through holes in wall 9*e* and are held therein by nuts. Thus, the movable walls 2*d* and 2*e* together with side walls 9*d* and, when provided, the floor means 6*d* form a rigid movable compacting unit. It will be apparent from the Figure that when joining two of the aforedescribed compacting apparatus to form a tandem, or double-acting compacting apparatus only one stationary compacting plate 1*d* is required, this stationary compacting plate being common to both of the moving plates. The movable compacting unit is driven reciprocatingly by means of a piston-cylinder-arrangement 5*d* and 4*d* arranged at one end of the apparatus. In this instance the movable plate 2*d* shown to the left of the Figure will be pulled towards the stationary plate 1*d* when the piston 5*d* is retracted in cylinder 4*d*, thereby to crush an object between the plates. The piston may be a differential piston or an equal-area piston. The cylinder is sealingly connected to the outer surface of the end wall 3*d* and is connected to a source of working medium (not shown). As with the single-compacting apparatus described in FIGS. 1 and 2, the apparatus illustrated in FIG. 3 may be provided with a floor extending between the movable walls 2*d* and 2*e* and having a free-fall aperture located adjacent respective ones of said movable walls. The stationary wall 1*d* will then have arranged therein slots which allow the floor means to pass therethrough, or the wall may be provided with a groove in which the floor can slide. Alternatively the stationary wall 1*d* and the end wall 3*d* may be of a size such that the movable walls 2*d* and 2*e*** and the floors therebetween are able to slide freely within the space defined by said fixed plate and said end wall.

In the aforedescribed embodiment, the object to be compacted can be fed from a feeding device into the respective spaces defined by respective movable walls **2*d* and 2*e* and the fixed wall 1*d* during a compacting operation, automatically by mechanically or electrically operated feeding and timing devices, or may be allowed to fall into said spaces gravitationally. An example of such a feeding device is a holding device having a mouth sufficiently large to accommodate the object to be compacted, one at the time, and having a long axis extending parallel to the path moved by the compaction plates. In order to prevent said material from falling from a respective holding device whilst the compacting unit is carrying out a compacting stroke with respect to the other feed device, as shown in FIG. 3 each of movable plate 2*d* and 2*e* has extending outwardly from the top thereof and at an angle thereto a tail 81 against which said object can rest whilst the compacting plate associated with said tail is making a compacting stroke. The tails 81 are also arranged to close the spaces behind a respective compacting plate during a compacting stroke. Thus, as the plate 2*e* to the right of FIG. 3 is moved towards the fixed plate 1*d* its tail 81 will be moved across the mouth of the holding device, to prevent an object held therein from falling into the space between the opposing faces of the movable plate 2*e* and the end plate 3*d***.

As indicated in FIG. 3, each of the movable walls may be provided with a device for removing the ends of cans when said cans are compacted in their axial direction. The illustrated device comprises a tube 72 extending through each of the plates **2*d* and arranged 2*e*** which is to protrude somewhat beyond the plane of said plate.

The protruding end of said tube may be provided with a cutting edge 73 or may be serrated to provide cutting teeth. The diameter of the tube will be slightly smaller than the diameter of the tin being compacted, the removed ends of respective tins being forced through the tube by subsequently removed ends, to fall from the machine on the side of the plate **2*d* or 2*e* remote from the stationary plate 1*d*. Severed ends of respective cans are shown at 74. Obviously, when such a cutting device is provided, the piston of the piston-cylinder arrangement must be off-set relative to the cutting device in order to allow the cut ends of the cans to be forced out by subsequently cut can-ends, as illustrated by the support element 75**.

I claim:

1. A compacting apparatus in which the material to be compacted is a can or drum comprising a first compacting plate;

a second compacting plate;

means for mounting said second compacting plate for reciprocating movement relative to said first compacting plate;

drive means coupled to at least one of said plates for providing said relative movement;

means defining a free-fall aperture between said first and second plates and adjacent one of said plates; and means for removing an end cover of the can or drum during a compacting operation.

2. An apparatus as claimed in claim 1, wherein said means for removing comprises a tube extending generally centrally through said first plate and having a pronounced cutting surface facing said second movable plate, the diameter of the can or drum being compacted.

3. An apparatus as claimed in claim 1, wherein said means for removing comprises a bore extending generally centrally through said first plate, and cutting means arranged peripherally around the mouth of said bore facing said movable plate, and wherein the diameter of said bore is slightly smaller than the diameter of the can or drum being compacted.

4. A double-acting compacting apparatus comprising a first compacting plate, a second compacting plate attached to and spaced from said first compacting plate; a third, stationary compacting plate arranged between said first and said second compacting plates; means for mounting said first compacting plate and said second compacting plate for movement relative to said third compacting plate; drive means coupled to at least one of said plates for providing movement of said first and second plates relative to said third plate; and means for defining a free-fall aperture arranged such that compacted material can automatically fall freely from the apparatus upon completion of a compaction stroke.

5. An apparatus as claimed in claim 4 wherein a drive means is arranged at each end of the apparatus.

* * * * *

UNITED STATES PATENT AND TRADEMARK OFFICE

CERTIFICATE OF CORRECTION

PATENT NO. : 4,213,386
DATED : July 22, 1980
INVENTOR(S) : Vera I. Telling

It is certified that error appears in the above-identified patent and that said Letters Patent are hereby corrected as shown below:

In line 5 of claim 2, after "diameter of" insert:

--said tube being slightly smaller than the diameter of--.

Signed and Sealed this

*Ninth* Day of *December 1980*

[SEAL]

*Attest:*

SIDNEY A. DIAMOND

*Attesting Officer*

*Commissioner of Patents and Trademarks*